US006238517B1

(12) United States Patent
Bokström et al.

(10) Patent No.: US 6,238,517 B1
(45) Date of Patent: May 29, 2001

(54) METHOD FOR CONTROLLING OXYGEN DELIGNIFICATION OF PULP

(75) Inventors: Monica Bokström, Kovland; Jan-Eric Häggqvist, Kvissleby, both of (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/308,820

(22) PCT Filed: Nov. 6, 1997

(86) PCT No.: PCT/SE97/01852

§ 371 Date: May 25, 1999

§ 102(e) Date: May 25, 1999

(87) PCT Pub. No.: WO98/23810

PCT Pub. Date: Jun. 4, 1998

(30) Foreign Application Priority Data

Nov. 26, 1996 (SE) ..... 9604350

(51) Int. Cl.[7] ..... D21C 7/12; D21C 9/147

(52) U.S. Cl. ..... 162/49; 162/61; 162/62; 162/65; 162/238

(58) Field of Search ..... 162/65, 49, 263, 162/238, 198, 61, 62

(56) References Cited

U.S. PATENT DOCUMENTS

| | | | | |
|---|---|---|---|---|
| 3,944,463 | * | 3/1976 | Samuelson et al. | 162/65 |
| 4,419,184 | | 12/1983 | Backlund . | |
| 4,840,703 | | 6/1989 | Malmsten | 162/49 |
| 5,034,095 | * | 7/1991 | Kido et al. | 162/49 |
| 5,217,575 | | 6/1993 | Backlund . | |
| 5,672,247 | * | 9/1997 | Pangalos et al. | 162/238 |

FOREIGN PATENT DOCUMENTS 1057906 7/1979 (CA) .

97/15715 5/1997 (WO) .

OTHER PUBLICATIONS

Pulp & Paper, "Improved Fiberline Automation Helps Swedish Mill Produce ECF, TCF Pulp", pp. 103–107, Mar. 1994.*

Optimization and Activation of Two–stage Oxygen Delignification, Xiang–Lian Li, Helsinki University of Technology, 1995.

Modelling and Control of Oxygen Delignification, Sven–Olof Lundqvist, Royal Institute of Technology, Stockholm 1993.

The Bleaching of Pulp, Tappi Press 1989, p. 166.

Mill Scale Multistage Oxygen Delignification, Peder J. Kleppe, International Non–Chlorine Bleaching Conference, Florida 1994.

Training for Nanning Pulp Mill, 1995.

Pulp Bleaching—Principles and Practice, Carlton W. Dence et al. Tappi Atlanta 1996, p. 19, table 11.

* cited by examiner

*Primary Examiner*—Steve Alvo

(74) *Attorney, Agent, or Firm*—Lerner, David, Littenberg, Krumholz & Mentlik, LLP

(57) ABSTRACT

Methods of controlling oxygen delignification processes are disclosed including providing chemicals for a first oxygen delignification step, conducting the first oxygen delignification step with the chemicals, conducting a second oxygen delignification step at a predetermined temperature to produce a delignified pulp, measuring the final kappa number of the delignified pulp subsequent to the second oxygen delignification step, adjusting the chemicals provided for the first oxygen delignification step based upon the difference between the actual kappa number reduction and the desired kappa number reduction for the pulp, and adjusting the predetermined temperature based on the chemicals provided to the first oxygen delignification step in order to provide the delignified pulp at a final pH of from about 10.5 to about 11.5.

4 Claims, 1 Drawing Sheet

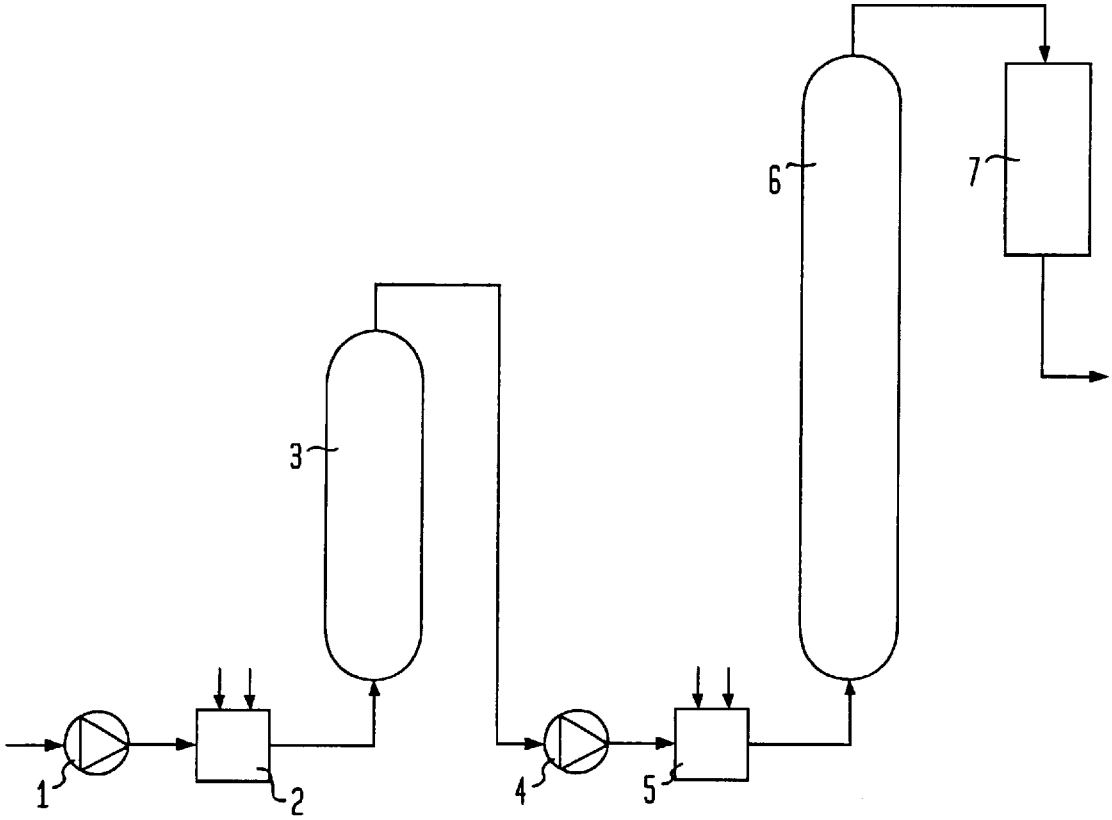
1
2
3
4
5
6
7

METHOD FOR CONTROLLING OXYGEN DELIGNIFICATION OF PULP

FIELD OF THE INVENTION

The present invention relates to the control of a method for oxygen delignification of lignocellulosic material in two steps at medium consistency, i.e., between about 8% and 16%.

Since the introduction of oxygen delignification at medium consistency, not much development effort has been invested in this process. With the development of chlorine free bleaching and closure of bleach plants, the interest in extended delignification, i.e. further reduction of the kappa number with oxygen, has increased. Extended delignification with oxygen in one or several stages, however, can result in deterioration in pulp quality. Application of proper conditions, however, can bring about several advantages.

With extended oxygen delignification the pulp yield can also be maintained at a higher level than with extended cooking, i.e. cooking to lower kappa number.

In a multi-stage method, the chemicals can be distributed between the stages so as to create optimum conditions in each stage. Other conditions can also be optimized for each stage.

The object of the present invention is to provide a method of controlling oxygen delignification in a manner such that a lower kappa number is obtained without deterioration of the pulp properties.

SUMMARY OF THE INVENTION

In accordance with the present invention, these and other objects have now been realized by the invention of a method for controlling an oxygen delignification process for a pulp having an initial kappa number in order to produce a delignified pulp having a desired kappa number reduction, the method comprising providing chemicals for a first oxygen delignification step, conducting the first oxygen delignification step with the chemicals, conducting a second oxygen delignification step at a predetermined temperature to produce the delignified pulp, measuring the final kappa number of the delignified pulp subsequent to the second oxygen delignification step, adjusting the chemicals provided for the first oxygen delignification step based upon the difference between the actual kappa number reduction from the initial kappa number to the final kappa number and the desired kappa number reduction, and adjusting the predetermined temperature based on the chemicals provided to the first oxygen delignification step in order to provide the delignified pulp at a final pH of from about 10.5 to about 11.5. In a preferred embodiment, the majority of the chemicals for the first and second oxygen delignification steps comprises the chemicals for the first oxygen delignification step. In another preferred embodiment, all of the chemicals for the first and second oxygen delignification steps comprise the chemicals for the first oxygen delignification step.

By using the extended delignification process according to the present invention, the total delignification can amount to from about 50% to 85% of the lignin content (kappa number) of unbleached pulp. The method is carried out at medium consistency in two subsequent steps.

BRIEF DESCRIPTION OF THE DRAWINGS

The present invention is described in greater detail in the following detailed description, with reference to the accompanying FIGURE, which is a schematic representation of a plant for carrying out the method according to the present invention.

DETAILED DESCRIPTION

In the plant shown in the FIGURE, cooked pulp is pumped at medium consistency, i.e., from about 8% to 16%, by a first pump 1 from the brown pulp washing to the oxygen delignification process. Alkali is charged to the pulp upstream of the first pump 1. After this pump 1 a first mixer 2 is used for admixing oxygen to the pulp. The pulp is thereafter supplied to a first reactor 3, in which the first delignification stage is carried out. The pulp is then transferred form the first reactor 3, possibly by means of a second-pump 4, by means of a second mixer 5 for admixing steam and possibly more oxygen and alkali, to a second reactor 6 for the second delignification stage. After the second reactor 6 the pulp is transferred to a blow tank 7 and thereafter to subsequent processing stages.

The method thus implies that the delignification is carried out in two subsequent stages. To the first reactor 3 high alkali addition as well as high oxygen addition are provided. This requires a charge of from about 10 to 50 kg of alkali (NaOH) per ton of pulp, preferably from about 10 to 35 kg/ton. The oxygen charge should be from about 10 to 50 kg/ton pulp, preferably from about 10 to 30 kg/ton.

The temperature of the pulp as it is fed to the reactor 3 should be below about 90° C., preferably from about 75 to 90° C. The retention time in the reactor 3 should be relatively short, i.e. from about 5 to 30 min, preferably from about 15 to 25 min.

The pressure in the first reactor 3 should be from about 4 to 15 bar. The high pressure, together with the high alkalinity of the pulp and the high oxygen charge, result in a high delignification rate. At the same time, the rate of cellulose degradation is held to a low level due to the relatively low temperature and the short retention time.

After the first delignification stage in the first reactor 3 the pulp is moved to the second delignification stage in the second reactor 6. The temperature in the second reactor 6 should be higher than that in the first reactor 3. The temperature difference, however, should be less than about 20° C., preferably from about 10 to 15° C. In order to bring about the necessary increase in temperature, steam is supplied to the second mixer 5.

The pressure in the second reactor should be from about 2 to 5 bar and lower than that in the first reactor 3. The retention time in the second reactor should be relatively long, i.e. from abut 45 to 180 min, preferably from about 60 to 120 min.

The second delignification stage is primarily a long extraction stage, where, in relation to the first step, the increased temperature and extended retention time provide extended delignification. At temperatures above about 90° C., thus, a good extraction/leaching rate is obtained.

The entire or majority of the chemical addition is made to the first stage. It is preferred that a very small or, in fact, no addition of alkali or oxygen should be made to the second stage, and preferably not even an amount compensating for the consumption in the first stage. The alkalinity of the pulp can thus be held relatively low in the second stage. In this manner, cellulose degradation is substantially avoided, in spite of the high temperature and long retention time.

The charge of alkali and oxygen to the second stage, respectively, can be up to about 5 kg/ton pulp.

The control of the oxygen delignification according to the present invention is based on forward control, which means that it implies the least possible back feed coupling. The control is carried out as follows.

The kappa number of the ingoing pulp is measured and compared to the desired value (set value) of the kappa number of the pulp after oxygen delignification. The reduction of the kappa number thus determined is used for adjusting the chemical addition (oxygen, alkali) to the first stage. A greater kappa number reduction thus implies a higher charge, calculated on the basis of reduced kappa number unit. The level of the kappa number of the ingoing pulp is also used for adjusting the chemical charge, so that a higher ingoing kappa number implies a lower charge, also calculated on the basis of reduced kappa number unit. For instance, a kappa number reduction of about 60%, such as from kappa 25 to kappa 10, implies an alkali charge measured in kg NaOH/ton pulp of about 2.2 times (ingoing kappa minus outgoing kappa). A delignification of 50% from kappa 25 to kappa 12.5 implies an alkali charge of 2.0 times (ingoing kappa minus outgoing kappa). A delignification of 50% from kappa 20 to kappa 10 implies an alkali charge of 2.2 times (ingoing kappa minus outgoing kappa). The exact factor is corrected in each individual case by means of the kappa number actually obtained in relation to the final pH value. If the final pH is somewhat high and the kappa number is somewhat low, the alkali charge is adjusted somewhat downwards. If the final pH is somewhat low and the kappa number somewhat high, the alkali charge is adjusted somewhat upwards.

Oxygen is charged in the relation 1:1 to the alkali charge, but with a maximum oxygen charge of from about 25 to 30 kg/ton pulp. When the degree of delignification is higher, i.e., when the alkali charge exceeds from about 25 to 30 kg NaOH/ton pulp, the ratio between oxygen and alkali charge is reduced. In this manner, it is possible to avoid gas channeling as a result of the presence of large amounts of gas.

The temperature level in the second stage is controlled partly in the usual manner by the production level, i.e. the so-called kappa factor control, and partly by means of the chemical addition to the first stage, so that a higher chemical charge to the first stage should result in a higher temperature in the second stage. The temperature is controlled so that a final pH of from about 10.5 to 11.5, preferably from about 10.7 to 11.0, is obtained. The factor between a change in chemical charge and the temperature level is adjusted manually by means of a final pH as mentioned above. However, the increase in temperature between the first and second stage should always be less than about 20° C., preferably from about 10 to 15° C., in order to avoid too large cellulose degradation due to high temperature.

Normally, however, no compensation takes place of the temperature in the first stage with respect to the chemical addition and production level. The pulp ingoing to the first stage is not heated, but it may require some cooling, so that a temperature suitably low for the process is obtained, i.e. below about 90° C.

The control of the oxygen delignification according to the present invention implies that a high degree of delignification with good selectivity can be obtained. A low and even kappa number and an even pH-value can be obtained after the second delignification stage.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of controlling an oxygen delignification process for a pulp having an initial kappa number in order to produce a delignified pulp having a desired kappa number reduction and a final pH of from about 10.5 to 11.5, said method comprising providing chemicals for a U.S. application Ser. No. 09/308,820 first oxygen delignification step with said pulp at a temperature of below about 90° C., conducting said first oxygen delignification step with said chemicals without manipulation of temperature, conducting a second oxygen delignification step at a predetermined temperature to produce said delignified pulp, measuring the final kappa number of said delignified pulp subsequent to said second oxygen delignification step, adjusting said chemicals provided for said first oxygen delignification step and adjusting said temperature only in said second oxygen delignification step based upon said chemicals provided to said first oxygen delignification step and the difference between the measured actual kappa number reduction from said initial kappa number to said final kappa number and said desired kappa number reduction and the measured final pH.

2. The method of claim 1 wherein the majority of the chemicals for said first and second oxygen delignification steps comprises said chemicals for said first oxygen delignification step.

3. The method as claimed in claim 1, wherein said initial kappa is used to determine the amount of chemicals provided to said first oxygen delignification step.

4. The method as claimed in claim 1, wherein said initial kappa is used to determine said predetermined temperature in said second oxygen delignification step.

* * * * *

UNITED STATES PATENT AND TRADEMARK OFFICE

CERTIFICATE OF CORRECTION

PATENT NO. : 6,238,517 B1
DATED : May 29, 2001
INVENTOR(S) : Bokström et al.

It is certified that error appears in the above-identified patent and that said Letters Patent is hereby corrected as shown below:

Column 2,
Line 11, "form" should read -- from --.

Column 4,
Line 24, delete "U.S. applica-".
Line 25, delete "tion Ser. No. 09/308,820"

Signed and Sealed this

Nineteenth Day of February, 2002

*Attest:*

*Attesting Officer*

JAMES E. ROGAN
*Director of the United States Patent and Trademark Office*